US006681961B2

(12) United States Patent
Parés Montaner et al.

(10) Patent No.: US 6,681,961 B2
(45) Date of Patent: Jan. 27, 2004

(54) PUMP HAVING A DECOMPRESSION DEVICE

(75) Inventors: Pedro Parés Montaner, Esplugues de Llobregat (ES); Victor Ribera Turró , Barcelona (ES)

(73) Assignee: Saint-Gobain Calmar, S.A., Barcelona (ES)

( * ) Notice: Subject to any disclaimer, the term of this patent is extended or adjusted under 35 U.S.C. 154(b) by 63 days.

(21) Appl. No.: 10/019,723

(22) PCT Filed: May 3, 2001

(86) PCT No.: PCT/ES01/00168

§ 371 (c)(1),
(2), (4) Date: Jan. 2, 2002

(87) PCT Pub. No.: WO01/87495

PCT Pub. Date: Nov. 22, 2001

(65) Prior Publication Data

US 2003/0102332 A1 Jun. 5, 2003

(30) Foreign Application Priority Data

May 16, 2000 (ES) ..... 0001209

(51) Int. Cl.[7] ..... B67D 5/42
(52) U.S. Cl. ..... 222/321.1; 222/321.9
(58) Field of Search ..... 222/321.1, 321.2, 222/321.7, 321.9

(56) References Cited

U.S. PATENT DOCUMENTS

| | | | | | |
|---|---|---|---|---|---|
| 3,770,206 | A | | 11/1973 | Tada | |
| 3,774,849 | A | * | 11/1973 | Boris | 222/321.2 |
| 4,262,823 | A | * | 4/1981 | Monden | 222/321.9 |
| 4,941,595 | A | * | 7/1990 | Montaner et al. | 222/321.2 |
| 5,064,105 | A | * | 11/1991 | Montaner | 222/321.2 |
| 5,503,306 | A | * | 4/1996 | Knickerbocker | 222/321.1 |
| 5,638,996 | A | * | 6/1997 | Montaner et al. | 222/321.2 |
| 5,655,688 | A | * | 8/1997 | Moore | 222/321.2 |
| 5,947,340 | A | * | 9/1999 | Arnold et al. | 222/321.9 |
| 6,050,457 | A | * | 4/2000 | Arnold et al. | 222/321.9 |

FOREIGN PATENT DOCUMENTS

| | | |
|---|---|---|
| EP | 0516472 | 12/1992 |
| FR | 2781768 | 2/2000 |
| GB | 2273532 | 6/1994 |
| WO | 09500253 | 1/1995 |

* cited by examiner

*Primary Examiner*—Kenneth Bomberg
(74) *Attorney, Agent, or Firm*—Staas & Halsey LLP

(57) ABSTRACT

A pump having a decompression device, appropriate for pumping a fluid from a container to an external environment, the pump including a jacket defining an inner space, a pumping chamber (17) housed in the inner space a piston for movement within the inner space between an extended position and a retracted position, and a decompression device which, when the piston is in the retracted position, places the pumping chamber in communication with a conduit communicating with the external environment.

8 Claims, 2 Drawing Sheets

PUMP HAVING A DECOMPRESSION DEVICE

BACKGROUND OF THE INVENTION

1. Field of the Invention

This invention relates to a pump having a decompression device, appropriate for pumping a fluid from a container to an external environment, comprising a jacket defining an inner space, a pumping chamber housed in the inner space of the jacket, and a piston for movement within the inner space of the jacket between an extended position and a retracted position.

2. Description of Related Art

Several variants of this type of pump are known. Movement of the piston modifies the volume of the pumping chamber. On reducing the volume of the pumping chamber, the pressure on the fluid contained therein increases. If this fluid is a liquid, the pressure increases very quickly to high values, and an outlet valve through which the liquid is discharged opens. When the volume of the pumping chamber is increased, a low pressure is generated, causing the outlet valve to close and an inlet valve through which liquid from the container enters is caused to open. Nevertheless, if the fluid contained is a gas, for example air, the pump will generally not work, since the gas is easily compressed and the pressure reached thereby is usually insufficient to open the outlet valve. Therefore, the air is not evacuated. When the volume of the pumping chamber is increased, no depression is created, but rather the internal gas, which is pressurized, expands to reach a final pressure similar to the starting pressure, whereby neither inlet valve nor the outlet valve open. Therefore, the pump requires a purge system allowing this gas to be evacuated.

Pumps of this type usually have a purge system allowing the gas contained in the pumping chamber to be evacuated to the fluid container. This purge system is usually a decompression device which, when the pumping chamber has the smallest volume, i.e., when the pressure of the air contained in the decompression chamber reaches a maximum level, places the pumping chamber in communication with the interior of the container.

This solution, nevertheless, is not desirable when it is desired to pump products that must not be contacted with the air, at least up to the time of use thereof, for example, to avoid drying, oxidation and/or contamination problems.

Containers are known which do not replace the discharged liquid volume with air, but reduce the internal volume of the container, for example, by deformation of the container itself or by movement of a plunger.

SUMMARY OF THE INVENTION

It is an object of the invention to provide a pump having a decompression device which may be coupled to one of these containers and which avoids all contact of the liquid with the outside air, until the time of use thereof. This aim is achieved by a pump having a decompression device of the type first mentioned above, comprising a decompression device which, when said piston is in said retracted position, places said pumping chamber in communication with a conduit communicating with said external environment.

Effectively, in this way the air is evacuated from the decompression chamber to a place (the environment external to the pump) where it does not contact the liquid. Generally, this evacuation may take place through any conduit, particularly a conduit in direct communication with the external environment. Nevertheless, a preferred solution is obtained when the pump is provided with a piston comprising a hollow stem defining a communication passage and the conduit is in communication with said communication passage. It should be borne in mind that, when placing the pumping chamber in communication with the conduit, when the piston is in the retracted position, a certain amount of liquid might be discharged through the conduit, since the pumping chamber is pressurized to some extent. Therefore, when the conduit is placed in communication with the communication passage, the possible discharge of the product through an undesired place is avoided, while the conduit is still in communication with the outside, albeit in this case through the communication passage, such that the air may be freely discharged.

The conduit should only be in communication with the pumping chamber when the piston is in the retracted position. This is achieved advantageously by providing the decompression device with a lower lip disposed on the piston and which is interposed between the pumping chamber and the conduit. This lower lip is advantageously resiliently deformed by one or more shoulders disposed in the chamber when the piston is in the retracted position, establishing communication between the pumping chamber and the conduit.

The piston is usually provided with at least one portion which is generally cylindrical, and which defines an outer side surface. The piston slides inside the jacket, which is also provided with at least one generally cylindrical portion and which defines an inner side surface, which faces the outer lateral surface of the piston. There is a certain degree of clearance between the piston and the jacket, allowing an intermediate space, located between both surfaces and between two lips with which the pistons are usually provided to form a tight seal with the jacket, to be defined. A preferred embodiment of the invention is achieved when the conduit is made to communicate with this intermediate space.

Finally, a further advantageous embodiment of the invention is achieved when the piston is provided with a second upper lip, which improves the seal between the pumping chamber and the external environment.

BRIEF DESCRIPTION OF THE DRAWINGS

Further advantages and features of the invention will be appreciated from the following description, wherein without any limiting nature, there is related preferred embodiments of the invention, with reference to the accompanying drawings, in which.

DESCRIPTION OF THE EMBODIMENTS

Figure 1:
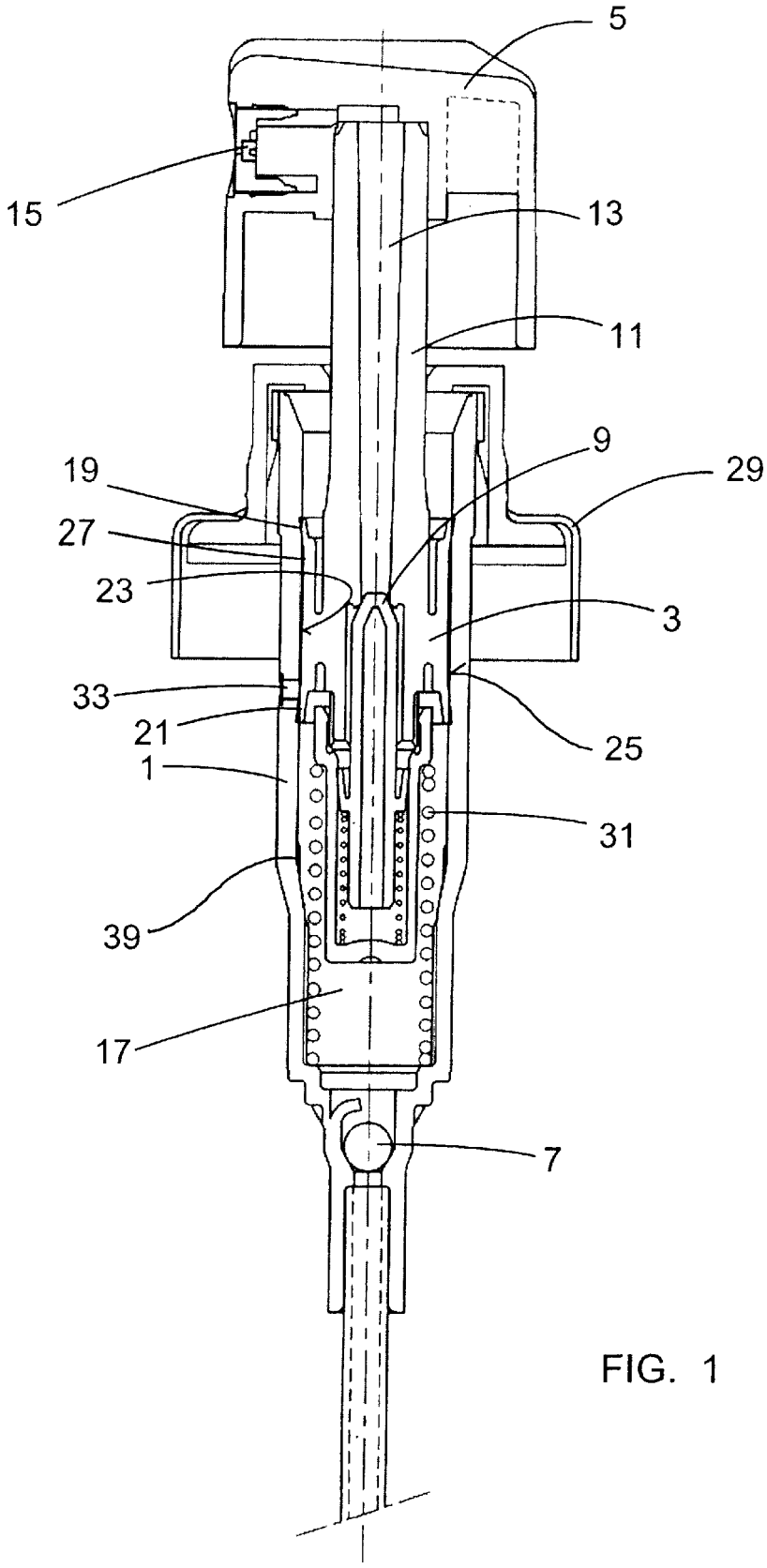
FIG. 1 is a longitudinal section view of a conventional pump.
Figure 2:
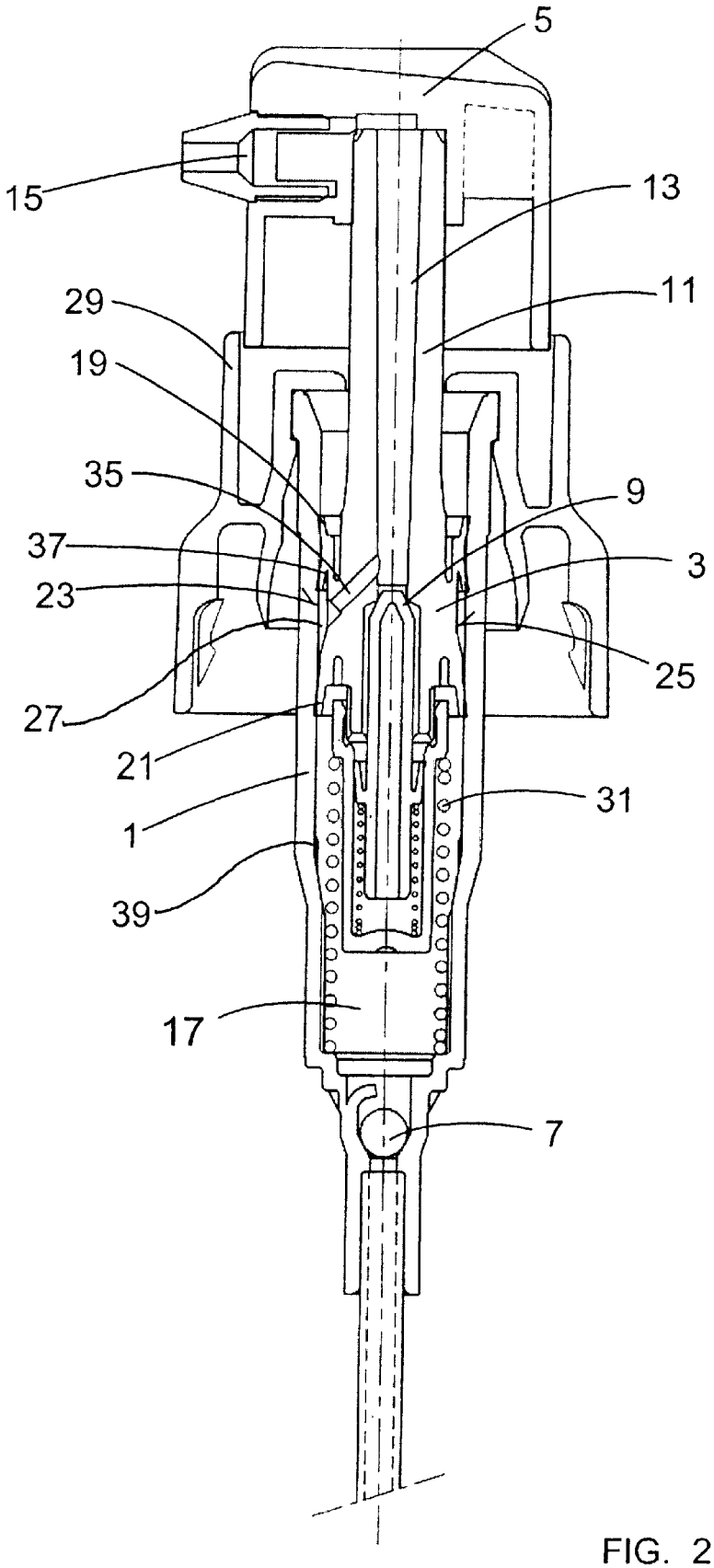
FIG. 2 is a longitudinal section view of a pump according to the invention.

The pumps shown in FIGS. 1 and 2 have a jacket 1, a piston 3, a press cap 5, an inlet valve 7 and an outlet valve 9.

The piston 3 is provided with a generally cylindrical portion housed in the interior of the jacket 1 and a hollow stem 11 defining a communication passage 13 which extends from the outlet valve 9 to a spray member 15 housed in the press cap 5. The liquid is discharged to the external environment through this spray member 15.

Between the piston 3 and the jacket 1 there is formed a pumping chamber 17. The size of the pumping chamber 17 varies as the piston 3 is moved between an extended position in which the pumping chamber 17 has a maximum volume and a retracted position in which the pumping chamber 17 has a minimum volume.

The cylindrical portion of the piston 3 is provided with an upper lip 19 and a lower lip 21. These lips allow for a tight seal between an inner side surface 23 of the jacket 1 and an outer side surface 25 of the piston 3. These two surfaces face each other and there is a certain degree of clearance therebetween so as to define an intermediate space 27.

The ensemble is attached to a container, not shown in the drawings, by means of a support 29.

A spring 31 allows the piston 3, after being pushed to the retracted position thereof by a user, to return alone to the extended position.

FIG. 1 shows the jacket 1 to have an orifice 33 placing the intermediate space 27 in communication with the interior of the container. In the pump according to FIG. 1, when there is air (or any other gas) in the pumping chamber 17, the piston 3 compresses the air contained in the pumping chamber 17 as it descends to the retracted position thereof, but the higher pressure created is not sufficient to open the outlet valve 9. Nevertheless, when the piston 3 reaches the retracted position thereof, the lower lip 21 is deformed by a shoulder 39, whereby the pumping chamber 17 is placed in communication with the intermediate space 27 and, therefore, with the interior of the container through the orifice 33. Thus, the pressurized air in the pumping chamber 17 is evacuated to the interior of the container and, during the upward movement of the piston 3 to the extended position thereof, the lower lip 21 reestablishes a seal and the required vacuum may be formed in the pumping chamber 17 for the inlet valve 7 to open and the liquid to be pumped in the pumping chamber 17 to flow in. When the pumping chamber 17 contains liquid, as the piston 3 is lowered, a rapid, high pressure is generated, opening the outlet valve 9, whereby the liquid is discharged. When the retracted position is reached, practically all the liquid to be pumped has been discharged through the communication passage 13 and, when the lower lip 21 is deformed, no appreciable amount of liquid is discharged to the intermediate space 27. In any case, the liquid remaining in the intermediate space 27 may exit through the orifice 33 and return to the container.

A preferred embodiment of the invention is shown in the pump according to FIG. 2. The piston 3 is provided with a conduit 35 extending between the intermediate space 27 and the communication passage 13. In this case, the air compressed in the pumping chamber 17 flows to the intermediate space 27 and to the communication passage 13, from where is may finally reach the external environment, through the spray member 15. Thus, the air can be evacuated from the pumping chamber 17, but contact of the air with the liquid in the container is avoided. This solution has the additional advantage than any small amounts of liquid that could accumulate in the intermediate space 27 can be evacuated to the communication passage 13 and, once in the communication passage 13, be evacuated jointly with the remaining liquid pumped through the spray member 15.

In the embodiment shown in FIG. 2 there is to be seen, additionally, the existence of a second upper lip 37. In fact, with the intermediate space 27 being in communication with the communication passage 13, the high pressures occurring in the communication passage 13 during the discharge of the liquid to be pumped are transmitted to the intermediate space 27. In certain cases, these high pressures may be in excess of those that the upper lip 19 can withstand without ceasing to provide a tight seal. In these cases, it may be necessary to add this second upper lip 37.

As may be seen, the decompression device according to the invention is independent of the shape and number of the inlet and outlet valves, of the way of operating the piston (by push button, by a lever, etc.), of the existence of additional fixed or mobile members in the pump having an influence on other functions, of the shape and number of springs, etc., whereby, according to the foregoing description, the man of the art will obviously appreciate that it is applicable to a large number of types of pumps.

What is claimed is:

1. A pump, for pumping a fluid from a container to an external environment, said pump comprising a jacket defining an inner space, a pumping chamber housed in said inner space of said jacket a piston adapted for movement within said inner space of said jacket between an extended position and a retracted position, and a decompression device which, when said piston is in said retracted position, places said pumping chamber in communication with a conduit, wherein the piston includes a hollow stem defining a communication passage to said external environment, wherein the conduit is located within the piston and is in communication with said communication passage, and wherein the decompression device includes a lower lip disposed on said piston, which lip is located between said pumping chamber and said conduit.

2. The pump of claim 1, wherein said decompression device further includes at least one shoulder disposed in said jacket for resiliently deforming said lower lip when said piston is in said retracted position, establishing a communication between said pumping chamber and said conduit.

3. The pump of claim 1, wherein said piston is provided with an outer side surface, said jacket is provided with an inner side surface, and between said outer side surface and said inner side surface there is an intermediate space, defined by said outer side surface, said inner side surface, said lower lip and an upper lip, and where said intermediate space is in communication with said conduit.

4. The pump of claim 3, wherein said piston is provided with a second upper lip.

5. A pump for pumping a fluid from a container to an external environment, said pump comprising a jacket defining an inner space, a pumping chamber housed in said inner space of said jacket, a piston adapted for movement within said inner space of said jacket between an extended position and a retracted position, wherein the pump is provided with a decompression device which, when said piston is in said retracted position, places said pumping chamber in communication with a conduit communicating with said external environment, wherein said piston is provided with an outer side surface, said jacket is provided with an inner side surface, between said outer side surface and said inner side surface there is an intermediate space defined by said outer side surface, said inner side surface, a lower lip and an upper lip, and where said intermediate space is in communication with said conduit, and wherein said piston is provided with a second upper lip.

6. The pump of claim 5, wherein said piston further comprises a hollow stem defining a communication passage, and wherein said conduit is in communication with said communication passage.

7. The pump of claim 5, wherein said lower lip is disposed on said piston between said pumping chamber and said conduit.

8. The pump of claim 5, wherein said decompression device includes at least one shoulder disposed in said jacket for resiliently deforming said lower lip when said piston is in said retracted position, establishing a communication between said pumping chamber and said conduit.

* * * * *